United States Patent [19]

Mäder

[11] 4,334,394

[45] Jun. 15, 1982

[54] INSULATED OUTER COATING OF WALLS OF BUILDING STRUCTURES

[75] Inventor: Karl Mäder, Rapperswil, Switzerland

[73] Assignee: IDC Chemie AG, Rapperswil, Switzerland

[21] Appl. No.: 155,011

[22] Filed: May 30, 1980

[30] Foreign Application Priority Data

Jun. 5, 1979 [CH] Switzerland ..... 5228/79

[51] Int. Cl.[3] ..... E04B 1/88

[52] U.S. Cl. ..... 52/309.12; 52/405; 52/675; 52/743

[58] Field of Search ..... 52/670, 675, 671, 672, 52/673, 674, 743, 309.12, 309.11, 405, 309.9, 454, 309.7, 309.8, 309.4, 309 B; 156/71, 78, 79; 264/46.7, 45.1, 34

[56] References Cited

U.S. PATENT DOCUMENTS

| | | | |
|---|---|---|---|
| 432,141 | 7/1890 | Kinney | 52/675 |
| 1,536,666 | 5/1925 | Franz | 52/675 |
| 2,357,560 | 9/1944 | Taford | 52/674 |
| 3,073,066 | 1/1956 | Edwards | 52/454 |
| 3,381,432 | 5/1968 | Brandwein | 52/309.11 |
| 3,601,945 | 8/1971 | Bernold | 52/673 |
| 3,619,437 | 11/1971 | McDonald | 52/309.8 |
| 3,839,519 | 10/1974 | Weiner | 264/46.7 |
| 4,151,239 | 4/1979 | Ogden | 52/309.11 |

FOREIGN PATENT DOCUMENTS

| | | | |
|---|---|---|---|
| 2623011 | 8/1977 | Fed. Rep. of Germany | 52/309.12 |
| 2287558 | 5/1976 | France | 52/309.8 |

*Primary Examiner*—John E. Murtagh

[57] ABSTRACT

The insulated outer coating of walls of building structures includes a cured foamed insulation material applied in a flowable state and an outer plaster means. Metal plates forming the moulding form for the injected foamed insulation material are connected by means of threaded bolts with the wall of the building structure, whereby a space is defined between the outer surface of said wall and the inner surface of each metal plate. A flowable insulation material containing urea-formaldehyde is injected into this space and cured therein. Each metal plate comprises protrusions and perforations. The perforations extend through the protrusions as well as through the metal plate. The plaster material applied on the outer face of the metal plates penetrates in its flowable state the penetrations and when cured in anchored by means of the protrusions and the penetrations. This arrangement allows the application of a not adhering or not sticking, respectively, insulation material, whereby the plaster is not carried by the insulation material but rather by the building wall itself. Conclusively, the insulation material is not subject to any forces stemming from the gravity of the plaster.

3 Claims, 4 Drawing Figures

INSULATED OUTER COATING OF WALLS OF BUILDING STRUCTURES

BACKGROUND OF THE INVENTION

1. Field of the Invention

The present invention relates to an improved insulated outer coating of walls of building structures including a cured foamed insulation material applied in a flowable state and an outer plaster means. The invention relates further to a method of insulating and providing an outer coating of walls of building structures by application of a foamed insulation material and an outer plaster means.

2. Description of the Prior Art

Commonly, the insulation of walls of buildings and subsequent applying of a plaster onto the walls prefabricated sheets of a foamed insulation material have been bonded to the wall of the building structure by utilization of an adhesive agent. After the curing of the adhesive agent these sheets or boards of foamed plastic material have been covered with a net-like structure of plastics material and thereafter the plaster for the wall has been applied onto such net. All known boards made of foamed plastics material feature customarily the disadvantage, in that they are structurally weak and additionally in that they accumulate and store condensate which leads to a weakening of these boards. Accordingly there is the danger that these boards grow increasingly weak due to the very weight of the plaster adhering thereto. This leads to cracks in these boards, to a rupturing and finally to a shearing off of the boards such that the outer coating severs from the wall proper of the building and falls off therefrom.

Further attempts have been made to insulate outer walls of buildings by the application of a PU-foam, which PU-foam is of such a structure which adhers to the building outer wall. Accordingly, such foamed material cures in place. However, the use of such material comprises the drawback that its outer surface after application of the material to the wall is quite irregular. This follows in that the outer surface of such cured foamy material must be ground down in order to obtain a flat, smooth outer surface, onto which the plaster proper may be applied. It is quite obvious that such grinding is a time-consuming task, and it has been proven that it is extremely difficult to obtain a regular smooth outer surface of the cured foam and accordingly of the outer plaster by such grinding method.

SUMMARY OF THE INVENTION

Hence, it is a general object of the present invention to provide an improved insulated outer coating of walls of building structures including a cured foamed insulation material and an outer plaster means. A further object of the present invention is to provide an improved method of insulating building structures by the application of a flowable foamed insulation material and an application of a plaster material.

Now, in order to implement these and still further objects of the invention, which will become more readily apparent as the description proceeds, the improved insulated outer coating of the present development is manifested by the features, that the insulation material contains urea-formaldehyde, and there is provided a moulding form means for said foamed insulation material, which moulding form means acts simultaneously as a carrier means for said outer plaster means.

A further object is to provide an improved insulated outer coating by providing an insulation material containing urea-formaldehyde and providing metal plates acting as a moulding form means for said foamed insulation material applied in a flowable state and acting simultaneously as carrier means for the outer plaster means, which metal plates are provided with pattern-like arranged perforated protrusions having perforations extending through the metal plates and wherein each of the metal plates is provided with screw bolts for connecting same with the outer wall of the building structure, which screw bolts are surrounded each by a sleeve made of a plastics material, which sleeves act as distance pieces for said metal plates, such to define the insulation thickness and to act as supporting means for said foamed insulation material.

A still further object is to provide an improved method of insulating a wall of a building structure and providing an outer coating of a plaster onto the wall by connecting a sheet-like moulding form means by means of distance pieces with said walls of building structures followed by an injection of a flowable foamed insulating material containing urea-formaldehyde into the space defined by the outer surface of said wall to be insulated and the inner surface of said sheet-like mould form means followed by allowing the foamed insulating material to cure and finally followed by applying a plaster material directly onto the outer surface of the sheet-like moulding form means.

BRIEF DESCRIPTION OF THE DRAWINGS

The invention will be better understood and objects other than those set forth above, will become apparent when consideration is given to the following detailed description thereof. Such description makes reference to the annexed drawings, wherein:

FIG. 4 a view of a section through an outer coating of a wall taken in the general area of a wall and adjacent opening for a window or the like.

DETAILED DESCRIPTION OF THE PREFERRED EMBODIMENT

Figure 1:
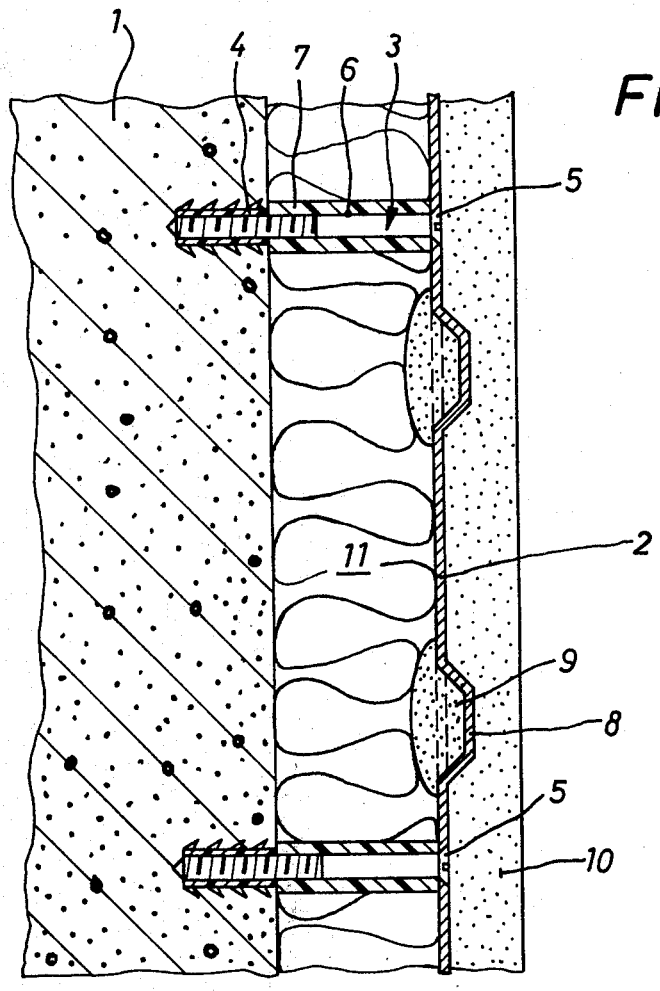
FIG. 1 is a view of a section through an outer coating of a wall of a building structure.

Describing now the drawings, and considering initially the exemplary embodiment of an insulated outer coating as shown in FIG. 1, it will be understood that a metal plate 2 is connected by the agency of screw bolts 3 to the wall 1 of the building, which wall may be fabricated of concrete or bricks, whereby the screw bolts 3 are provided with wall plugs 4 of common design. In the exemplary embodiment shown the screw bolts 3 are provided with heads 5 which are arranged sunk into the metal plate 2. The shank 6 of each screw bolt 3 is surrounded by a sleeve 7 made of a plastics material. This plastics sleeve 7 acts as distance piece, such that a predetermined distance between metal plate 2 and wall 1 can be chosen freely. The length of the plastics sleeve 7 can be chosen freely in accordance with the sought thickness of the insulating plastics layer, such as will be explained later on. The sleeves 7 are made specifically of a plastics material because plastics material is generally a bad heat conductor.

The outer surface of the metal plate 2, that is, the surface exposed to the plaster, is provided with a plurality of projections 8. The side flanks of the projections 8 are provided with apertures 9 which are arranged such that a connection is formed between the two opposing surfaces of the metal plate 2. The plaster 10 is applied at the outer surface of the metal plate 2. Between the metal plate 2 and the outer surface of the building wall 1 a layer 11 fabricated of a foamed plastics material is arranged, which layer 11 of foamed plastics material acts as heat- as well as e.g. sound insulation.

This layer 11 consists of foamed urea-formaldehyde.

The manufacture of foamed urea-formaldehyde and its suitability as heat insulating material is known. Urea-formaldehyde is superior to most other known foamed insulation materials, in that it stores no water, in that it repulses water and finally in that it can be penetrated by steam or water vapor, respectively.

Urea-formaldehyde is oftentimes used for foaming hollow spaces; however although it is much harder than all other known foamed materials, the art has not considered urea-formaldehyde as suitable for an application relating to an insulation of outer walls because urea-formaldehyde does not cling, does not adhere to other material.

Now, the sheet metal plate 2 is utilized as a moulding form for mentioned foamed material and in accordance with the inventive idea, it is for the first time possible to provide an outer insulation of foamed urea-formaldehyde.

This moulding form, i.e. the sheet-like metal plate 2 acts simultaneously as carrier means for the plaster 10. The reason that the plate 2 is made of metal and not of another material is that its coefficient of thermal extension is about the same as that of the plaster 10.

However, special attention must be paid to a good connection between the metal plate 2 and the plaster 10. The shown embodiment comprises an arrangement, according to which the plaster 10 is anchored and locked into the metal plate 2.

To this end, the metal plate 2 is provided at its outer surface intended for receiving the plaster 10 with an arrangement of protrusions 8, whereby the flanking sides of the protrusions 8 are provided with apertures 9. These protrusions 8 are shown in FIG. 1 in section and in FIG. 2 perspectively. The plaster 10 which may be applied onto the metal plate 2 in any known way penetrates in its still flowable state the apertures 9 and flows to the rear side of each section of the plate adjacent to the holes 9, embraces so to say the metal plate 2 at a multitude of locations and accordingly is rigidly anchored to the metal plate 2 after curing such that it is not possible that any portion of the plaster can fall off the metal plate. The manufacture of the protrusions 8 including the apertures 9 in the metal plate 2 proceeds according to known methods by means of stamping the corresponding sections of metal plate 2.

Figure 3:
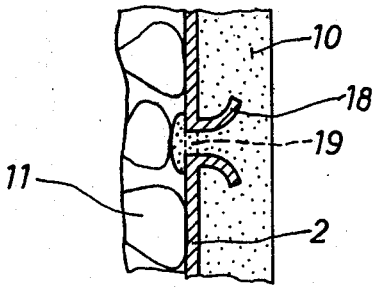
FIG. 3 is a section through a further embodiment of the anchoring members for the outer plaster.
Figure 2:
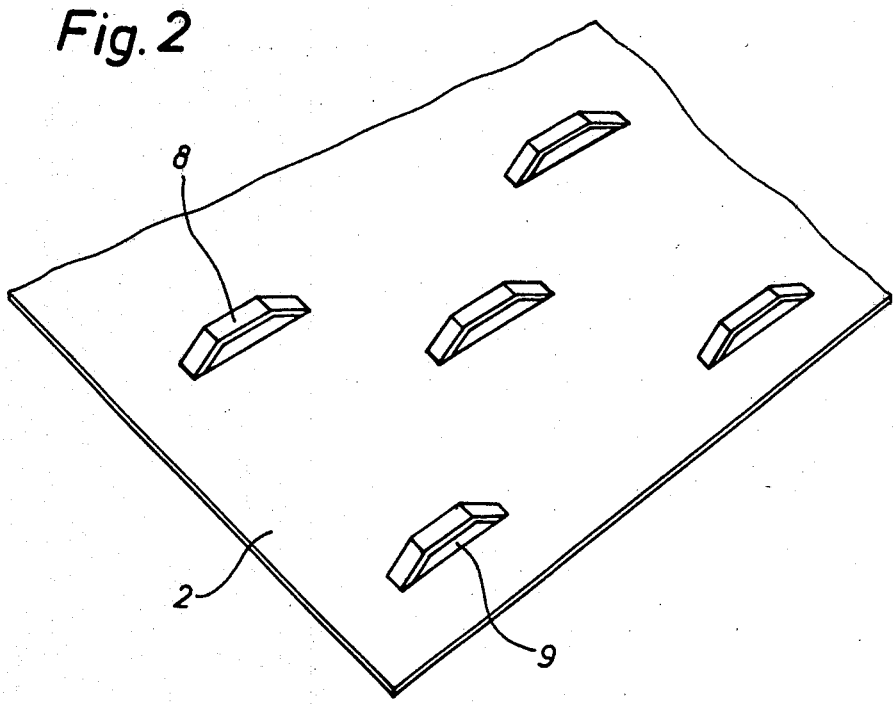
FIG. 2 a perspective view of a portion of the metal plate shown in FIG. 1.

In FIGS. 1 and 2 of the drawings there is shown a preferred embodiment of the shape of the protrusions 8 and apertures 9 forming the anchoring members. However, other shapes are contemplated and quite usable such as is for instance shown in FIG. 3. This embodiment comprises an aperture 19 formed in the metal plate 2, whereby the centerline of the circular aperture 19 extends perpendicularly to the metal plate 2. (In the previously shown embodiment according to FIG. 1 the centerline of the aperture 9 extends parallel to the metal plate 2.) The protrusion 18 of the embodiment shown in FIG. 3 has the shape of a trumpet-like ring section extending into the plaster 10, which trumpet shaped body surrounds the aperture 19.

The construction of the inventive insulating outer coating begins with the drilling of holes at predetermined locations into the building wall 1 followed by the insertion of wall plugs 4 into these holes. Thereafter, prefabricated and readily cut metal plates 2 having for instance a thickness of about ¼ inch will be screwed onto the building wall 1 by the aid of the screw bolts 3. Thereby, the length of the plastics sleeve 7 determines the thickness of the insulating layer proper, which depending on the prevailing conditions can extend from about 3 inches to 6 inches or more.

Thereafter the flowable foamed urea-formaldehyde material is injected in the space defined by the outer surface of wall 1 and the inner surface of the metal plate 2. This foamed material cures within about 48 hours, and thereafter the plaster is applied in any known way onto the metal plate 2. The applied plaster penetrates in its still flowable, i.e. not cured state, the apertures 9 or 19, respectively, and accordingly is anchored to the plate 2 after curing or hardening, respectively.

It is to be noted, that the cured foamed material 11 does not carry at any portion thereof any part of the plaster 10. All forces stemming from the weight of the plaster 10 are led via the metal plates and screw bolts directly into the building wall 1, which accordingly carries the plaster. The cured foamed insulation material is at no place subjected to any weight except its very own gravity. A damaging of the foamed material, a shearing off of the material due to forces acting from the outside onto the cured foam is therefore not possible.

Quite obviously it is necessary to provide special arrangements at areas forming penetrations through the building wall 1, such for instance at windows or doors. Such is now explained by reference to FIG. 4 of the drawings.

Figure 4:
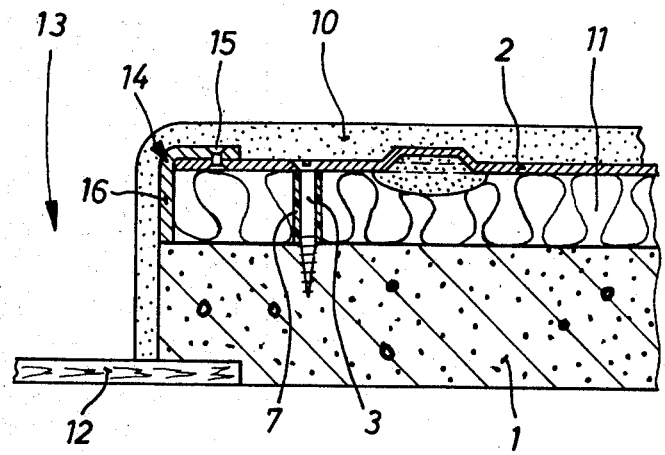

In FIG. 4 there is shown again the wall 1 of the building, whereby the reference numeral 12 denotes a section of a wooden window frame. (Obviously, such window- or door, respectively, frame may be made of any material.) The insertion of the window frame 12 into the wall 1 of the building is made in a known way and not discussed further herein. FIG. 4 shows further a portion of a metal plate 2 as described above, which metal plate 2 is connected to the building wall 1 by the agency of screw bolts 3 provided with the described plastics sleeve 7. Between the building wall 1 and the metal plate 2 there is arranged a layer 11 of cured foamed material and the outer side of the metal plate 2 is covered by the above discussed plaster 10.

The edge of the metal plate 2 facing the perforation or hole, respectively, of the wall 1 is connected to an angle iron 14. This angle iron 14 comprises also (not particularly shown) protrusions 8 and apertures 9 acting as anchoring members. This angle iron 14 is for instance connected by means of common bolts with a or several metal plates 2. Assuming that the height of a metal plate is about 1 foot and its length about 3 feet, it is obvious that several successive metal plates border the window opening, whereby all these metal plates are connected to each other by one common angle iron 14. The connection between angle iron and plate 2 can obviously be made also by other means, for instance by a welding. A leg 16 of the angle iron 14 lies on top of the outer surface of the building wall 1 and forms the lateral closure or cover of the space to be filled by the foamed material 11 or which is filled by the foamed material 11, respectively. Accordingly, the upper, the lower, the left and the right side wall of the square shaped aperture 13 made in the wall 1 for the later insertion of a window or door, respectively, is provided with such angle iron 14, whereby all metal plates arranged immediately adjacent the opening are connected by means of screw bolts or by weldings to the angle irons 14.

With such construction the plaster 10 can be applied onto the wall 1 cleanly and exactly until the window frame 12 as would be the case if no insulation would be present, i.e. if the outer surface of the wall proper would be simply concrete or brick.

The above disclosed outer coating is not only suitable for an application on new construction but specifically suitable for insulating existing buildings, old buildings at a later date commensurate with the present shortage of energy.

Oftentimes the outer coatings, i.e. the outer plasters of the buildings are provided with various structures for aesthetical reasons and are often subject to deformations. When applying at a later date an insulation onto such wall- or plaster, respectively, surfaces, it is necessary, that the plaster must be chipped off completely, such to arrive at a smooth wall surface, such to allow the bonding of the known prefabricated foamed plastics sheets or boards thereto, or onto which surfaces a flowable insulating material is to be applied. However, it must be remembered, that any hitherto known insulating material which is applied in a flowable state onto such walls calls as such for a lot of trouble regarding the formation of a smooth outer surface onto which the plaster is to be applied.

Because now in accordance with the invention plates 2 are arranged at a distance to the building wall 1, it is no longer necessary to treat any existing deformations of a building wall, such that insulating existing building walls on old buildings can be carried out much easier than it has been hitherto possible by the known means.

While there are shown and described present preferred embodiments of the invention, it is to be distinctly understood that the invention is not limited thereto, but may be otherwise variously embodied and practiced within the scope of the following claims. Accordingly,

What is claimed is:

1. An improved outer coating for vertically extending walls of building structures, including a cured foamed insulation material consisting of urea-formaldehyde applied in a flowable state;

an outer plaster material;

metal plates acting as a molding form means for said foamed urea-formaldehyde and simultaneously as a carrier means for said outer plaster material, which metal plates comprise pattern-like arranged protrusions having perforations extending through said protrusions;

wherein said metal plates are provided with screw bolts for connecting same with said vertical walls of the building structures, which said screw bolts are surrounded each by a sleeve made of a plastics material, which sleeves act as distance pieces for said metal plates and simultaneously as a supporting means for said foamed urea-formaldehyde insulation material.

2. The improved outer coating of claim 1, wherein each of said perforations is provided in a side section of said protrusions.

3. The improved outer coating of claim 2, wherein each said protrusions is an integrally bulged-out section of said metal plate.

* * * * *